US012780358B2

(12) United States Patent
Gao et al.

(10) Patent No.: US 12,780,358 B2
(45) Date of Patent: Nov. 3, 2026

(54) PRESSURE STABILIZING CAVUM STRUCTURE APPLICABLE TO AIR-LAYER DRAG REDUCTION SHIP

(71) Applicant: CSSC Shanghai Marine Energy Saving Technology Co., Ltd., Shanghai (CN)

(72) Inventors: Lijin Gao, Shanghai (CN); Shaofeng Chen, Shanghai (CN); Guofu Huang, Shanghai (CN); Qiuqin Yun, Shanghai (CN); Haochao Xia, Shanghai (CN); Zhouguang Yan, Shanghai (CN); Zan Wu, Shanghai (CN); Leiqiang Chen, Shanghai (CN); Shuquan Huang, Shanghai (CN)

(73) Assignee: CSSC Shanghai Marine Energy Saving Technology Co., Ltd., Shanghai (CN)

( * ) Notice: Subject to any disclaimer, the term of this patent is extended or adjusted under 35 U.S.C. 154(b) by 577 days.

(21) Appl. No.: 18/547,469

(22) PCT Filed: Mar. 4, 2021

(86) PCT No.: PCT/CN2021/079053
§ 371 (c)(1),
(2) Date: Aug. 22, 2023

(87) PCT Pub. No.: WO2022/178912
PCT Pub. Date: Sep. 1, 2022

(65) Prior Publication Data

US 2024/0140560 A1 May 2, 2024

(30) Foreign Application Priority Data

Feb. 23, 2021 (CN) ..... 202110204228.2

(51) Int. Cl.
*B63B 1/38* (2006.01)

(52) U.S. Cl.
CPC ..... *B63B 1/38* (2013.01); *B63B 2001/387* (2013.01)

(58) Field of Classification Search
CPC ..... B63B 1/38; B63B 2001/387
See application file for complete search history.

(56) References Cited

U.S. PATENT DOCUMENTS 3,650,235 A * 3/1972 Swanson ..... B63B 1/38 114/67 A
3,690,283 A * 9/1972 Pool ..... B63B 59/04 114/67 A (Continued)

FOREIGN PATENT DOCUMENTS

CN 102224064 A 10/2011
CN 108001610 A 5/2018

(Continued)

OTHER PUBLICATIONS

International Search Report issued on Sep. 26, 2021 for International Patent Application No. PCT/CN2021/079053 (2 pages).

(Continued)

*Primary Examiner* — S. Joseph Morano
*Assistant Examiner* — Jovon E Hayes
(74) *Attorney, Agent, or Firm* — Fox Rothschild LLP

(57) ABSTRACT

A pressure stabilizing cavum includes multiple PE pipes and a backing plate. The multiple PE pipes are inserted through a longitudinal keel of the ship. Each PE pipe is provided with a first opening. Both two sides of the each PE pipe in the width direction of the first opening are connected to a hull bottom plate of the ship to form a pressure stabilizing cavum. The backing plate is located between the each PE pipe and the hull bottom plate and is sealingly connected to the each PE pipe and the hull bottom plate. The backing plate is provided with a first through hole, and the hull bottom plate is provided with a second through hole com- (Continued)

municating with the first through hole, and the pressure stabilizing cavum communicates with the outside of the ship through the first through hole and the second through hole.

9 Claims, 3 Drawing Sheets

(56) References Cited

U.S. PATENT DOCUMENTS

| | | | | | |
|---|---|---|---|---|---|
| 5,456,201 | A * | 10/1995 | Bobst | B63B 1/38 D12/318 |
| 2002/0029731 | A1* | 3/2002 | Takahashi | B63B 1/38 114/67 R |
| 2004/0000265 | A1* | 1/2004 | Carson | B63B 1/34 114/67 R |
| 2011/0220002 | A1* | 9/2011 | Takano | B63B 1/38 114/67 A |
| 2022/0017182 | A1* | 1/2022 | Khreibani | B63B 1/38 |

FOREIGN PATENT DOCUMENTS

| | | | | | |
|---|---|---|---|---|---|
| CN | 108128401 | A | * | 6/2018 | B63B 1/38 |
| CN | 110758634 | A | * | 2/2020 | B63B 1/38 |
| CN | 111003102 | A | * | 4/2020 | B63B 1/38 |
| CN | 111086599 | A | * | 5/2020 | B63B 17/00 |
| CN | 211442668 | U | * | 9/2020 | |
| CN | 112810748 | A | | 5/2021 | |
| CN | 214420653 | U | | 10/2021 | |
| EP | 0903287 | A2 | * | 3/1999 | B05B 12/08 |
| EP | 4299430 | A1 | * | 1/2024 | B63B 1/38 |
| GB | 2505281 | A | * | 2/2014 | B63B 1/38 |
| JP | H10109684 | A | | 4/1998 | |
| JP | H11301570 | A | | 11/1999 | |
| JP | H11310188 | A | | 11/1999 | |
| JP | 2000128063 | A | | 5/2000 | |
| JP | 2001278177 | A | | 10/2001 | |
| JP | 2002002582 | A | | 1/2002 | |
| JP | 2012153276 | A | | 8/2012 | |
| JP | 2013129323 | A | | 7/2013 | |
| WO | 2012133625 | A1 | | 10/2012 | |
| WO | 2013002182 | A1 | | 1/2013 | |

OTHER PUBLICATIONS

First Chinese Search Report issued on Oct. 13, 2024 for Chinese Patent Application No. 2021102042282 (3 pages).

First Chinese Office Action issued on Oct. 17, 2024 for Chinese Patent Application No. 202110204228.2 (4 pages).

European Search Report issued on May 13, 2025 for European Patent Application No. 21927346.3 (11 pages).

Second Chinese Office Action issued on Mar. 13, 2025 for Chinese Patent Application No. 202110204228.2 (4 pages).

Chinese Supplementary Search Report issued on Mar. 10, 2025 for Chinese Patent Application No. 202110204228.2 (2 pages).

Office Action issued on May 21, 2024 in JP2023-551081.

* cited by examiner

PRESSURE STABILIZING CAVUM STRUCTURE APPLICABLE TO AIR-LAYER DRAG REDUCTION SHIP

CROSS-REFERENCE TO RELATED APPLICATION(S)

This is a national stage application filed under 37 U.S.C. 371 based on International Patent Application No. PCT/CN2021/079053, filed on Mar. 4, 2021, which claims priority to Chinese Patent Application No. 202110204228.2 filed with the China National Intellectual Property Administration (CNIPA) on Feb. 23, 2021, the disclosures of which are incorporated herein by reference in their entirety.

TECHNICAL FIELD

The present application relates to the technical field of energy saving and drag reduction for ships, for example, a pressure stabilizing cavum structure applicable to an air layer drag reduction ship.

BACKGROUND

Air layer drag reduction technology refers to a new energy-saving technology in which a proper amount of air is injected into the bottom of a ship hull through an air layer drag reduction apparatus. This action forms and maintains a thin air layer at the hull bottom, effectively isolating the hull from water, reducing the wetted surface area of the bottom of the hull, thereby lowering the friction resistance, fuel consumption, and $CO_2$ emissions. When applied to an actual ship, the air layer drag reduction technology involves the following key technologies: 1) uniformity of air hole jet flows, and 2) formation and stable maintenance of an air layer at the hull bottom. The pressure-stabilizing cavum, as a key component in the air layer drag reduction system, embodies the air rectification and pressure stabilization technologies, allows air to fully decelerate and be rectified and stabilized in the pressure stabilizing cavum and ensures the consistency of the velocities and pressures of air injected from multiple air jet holes. This approach enables even injection of the air into the water, thereby facilitating the formation and maintenance of a uniform and stable air layer.

In the related art, there are two modes of mounting the pressure stabilizing cavum onto the actual ship: the non-backing plate type and the superposition type of backing plates. Different mounting modes may be selected according to factors such as navigation waters and ship characteristics. Due to a relatively small space of the pressure stabilizing cavum, a water-blocking apparatus cannot be disposed inside the narrow space. Therefore, reliance is only on one-way check valves and remote control valves disposed on an air transmission pipeline to prevent freshwater or seawater from entering the pressure stabilizing cavum. In the two preceding mounting modes, a jet head, a pressure stabilizing cavum body, a pressure stabilizing cavum backing plate, and the air transmission pipeline located at the front end of a one-way stop valve all use stainless steel or corrosion-resistant steel that resists seawater corrosion, constructing a partial corrosion-resistant space to reduce the corrosion problem caused by seawater ingress. However, because the service life of the ship spans several decades, the material industry cannot provide a clear conclusion as to whether the effective corrosion-resistant life of stainless steel or corrosion-resistant steel that resists seawater can match or exceed the service life of the ship. Therefore, it is impossible to fully solve the anticorrosion problem of the pressure stabilizing cavum.

SUMMARY

The present application provides a pressure stabilizing cavum structure applicable to an air layer drag reduction ship so that the anticorrosion problem of the pressure stabilizing cavum can be solved, and the corrosion risk caused by seawater entering the pressure stabilizing cavum can be eliminated.

A pressure stabilizing cavum structure applicable to an air layer drag reduction ship is provided. The pressure stabilizing cavum structure is disposed at a bottom of a hull of the ship and includes a plurality of polyethylene (PE) pipes and a backing plate.

The plurality of PE pipes extend along a width direction of a hull, are arranged in parallel and spaced apart along a length direction of the hull and are inserted through a longitudinal keel of the ship, each PE pipe of the plurality of PE pipes is provided with a first opening extending along the width direction of the hull, and both sides of the each PE pipe in a width direction of the first opening are connected to a hull bottom plate of the ship to form a pressure stabilizing cavum.

The backing plate extends along the width direction of the hull, is made of corrosion-resistant material, is located between the each PE pipe and the hull bottom plate and is sealingly connected to the each PE pipe and the hull bottom plate, the backing plate is provided with a first through hole, the hull bottom plate is provided with a second through hole communicating with the first through hole, and the pressure stabilizing cavum communicates with an outside of the ship through the first through hole and the second through hole.

REFERENCE LIST

Figure 1:
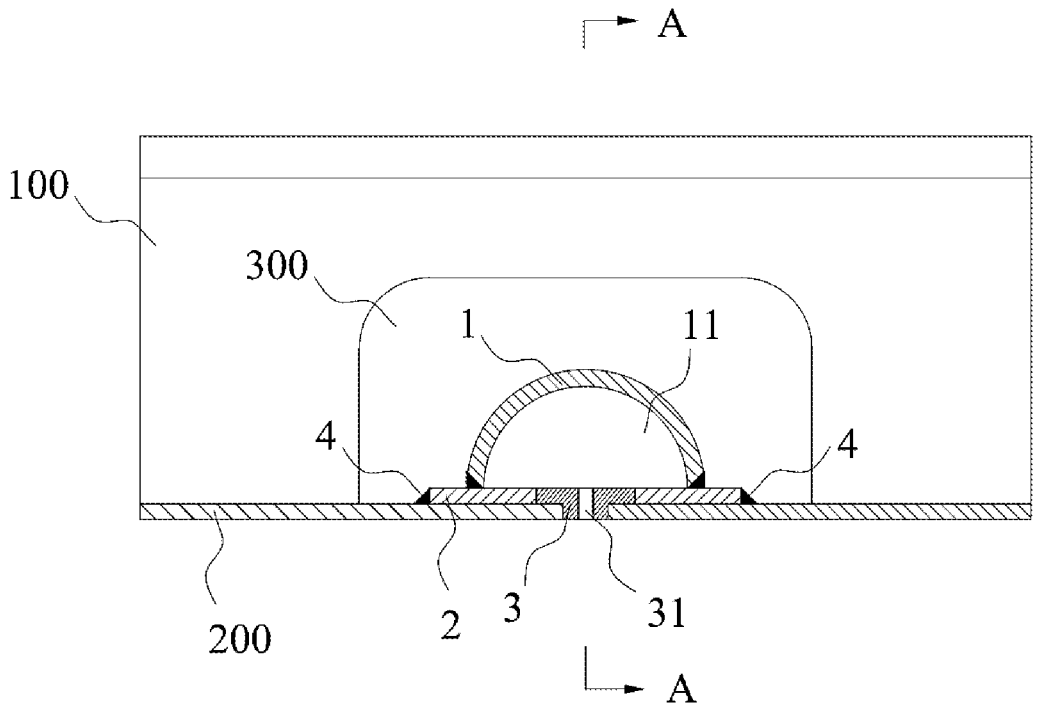
FIG. 1 is a diagram illustrating the structure of a pressure stabilizing cavum structure (without an outer sleeve, and with a backing plate made of PE material) applicable to an air layer drag reduction ship according to an embodiment of the present application.

100 longitudinal keel
200 hull bottom plate
300 reinforcement plate
1 PE pipe
11 pressure stabilizing cavum
2 backing plate
3 jet head
31 jet hole
4 first sealant

5 outer sleeve
6 fastener
7 second sealant

DETAILED DESCRIPTION

Technical solutions of the present application will be described below with reference to the drawings.

In the description of the present application, unless otherwise specified and limited, the term "connected to each other", "connected" or "secured" is to be construed in a broad sense, for example, as securely connected, detachably connected, or integrated; mechanically connected or electrically connected; directly connected to each other or indirectly connected to each other via an intermediary; or internally connected between two elements or interaction relations between two elements. Specific meanings of the preceding terms in the present application may be understood based on specific situations.

In the present application, unless otherwise expressly specified and limited, when a first feature is described as "on" or "below" a second feature, the first feature and the second feature may be in direct contact or be in contact via another feature between the two features instead of being in direct contact. Moreover, when the first feature is described as "on", "above", or "over" the second feature, the first feature is right on, above, or over the second feature or the first feature is obliquely on, above, or over the second feature, or the first feature is simply at a higher level than the second feature. When the first feature is described as "under", "below", or "underneath" the second feature, the first feature is right under, below, or underneath the second feature or the first feature is obliquely under, below, or underneath the second feature, or the first feature is simply at a lower level than the second feature.

The technical solutions of the present application are described hereinafter in conjunction with drawings and embodiments.

As shown in FIGS. 1 to 4, the pressure stabilizing cavum structure applicable to an air layer drag reduction ship is disposed at the bottom of a hull of the ship and includes PE pipes 1 and a backing plate 2. Multiple PE pipes 1 are provided, extend along the width direction of a hull, are arranged in parallel and spaced apart along the length direction of the hull and are inserted through a longitudinal keel 100 of the ship. Each PE pipe 1 is provided with a first opening extending along the width direction of the hull, and both sides of the each PE pipe 1 in the width direction of the first opening are connected to a hull bottom plate 200 of the ship to form a pressure stabilizing cavum 11. The backing plate 2 extends along the width direction of the hull, is made of corrosion-resistant material, is located between the each PE pipe 1 and the hull bottom plate 200 and is sealingly connected to the each PE pipe 1 and the hull bottom plate 200. The backing plate 2 is provided with a first through hole, and the hull bottom plate 200 is provided with a second through hole communicating with the first through hole, and the pressure stabilizing cavum 11 communicates with the outside of the ship through the first through hole and the second through hole. The each PE pipe 1 is connected to the hull bottom plate 200 to form the pressure stabilizing cavum 11, and the material of the cavum wall is PE material, so a better corrosion-resistant effect can be achieved compared with the steel material in the related art. Moreover, the backing plate 2 is disposed between the hull bottom plate 200 and the each PE pipe 1 to construct an independent space completely insulated from the hull bottom plate 200 so that the direct contact between the each PE pipe 1 and the hull bottom plate 200 can be avoided, avoiding corroding the hull bottom plate 200. Moreover, the backing plate 2 is made of corrosion-resistant material so that a better corrosion-resistant performance can be achieved, and the backing plate 2 is sealingly connected to the hull bottom plate 200 and the each PE pipe 1 so that the sealing performance of the connection between the backing plate 2 and the hull bottom plate 20 can be ensured, preventing seawater from entering and contacting the hull bottom plate 200. In addition, the backing plate 2 is provided with the first through hole, and the hull bottom plate 200 is provided with the second through hole, so air in the pressure stabilizing cavum 11 can be ejected from the first through hole and the second through hole, avoiding disposing a jet head 3 and simplifying the pressure stabilizing cavum structure.

The hull bottom plate 200 is a steel plate, and the backing plate 2 is disposed between the each PE pipe 1 and the hull bottom plate 200 so that the corrosion of the hull bottom plate 200 caused by seawater ingress can be avoided. The material of the cavum wall is PE material that may generally withstand pressure of 1 MPa. Different modes of PE material may bear different levels of pressure. PE materials may be selected according to different ship types.

In this embodiment, each PE pipe 1 with specific dimensions or customized shapes may be selected. The body of the pressure stabilizing cavum 11 is a narrow and long air passage disposed along the width direction of the ship and may be connected in segments. Two adjacent PE pipes 1 may be welded using hot melt or electric melt or a combination of the two. The cross section of the each PE pipe 1 is semicircular. In other embodiments, the cross section of the each PE pipe 1 may also be in another shape such as a rectangular shape.

In this embodiment, to ensure the structural stability of the longitudinal keel 100, two ends of the longitudinal keel 100 in the extension direction are each provided with a reinforcement plate 300, and the each PE pipe 1 is inserted through the reinforcement plate 300, and the outer wall of the each PE pipe 1 is fixedly connected to the reinforcement plate 300. The structural strength of the longitudinal keel 100 can be increased through the reinforcement plate 300 so that the stability of the longitudinal keel 100 can be improved.

The pressure stabilizing cavum structure applicable to an air layer drag reduction ship further includes the jet head 3 inserted through the first through hole and the second through hole and sealingly connected to the inner wall of the first through hole and the inner wall of the second through hole. A jet hole 31 is disposed inside the jet head 3. The pressure stabilizing cavum 11 communicates with the outside of the ship through the jet hole 31. The jet head 3 is made of PE material or steel material. The jet head 3 is disposed in the position of the first through hole and the position of the second through hole, and air is ejected through the jet hole 31 on the jet head 3. That is, in this embodiment, the jet hole 31 may be a through hole directly drilled on the backing plate 2 and the hull bottom plate 200, or the jet head 3 may also be disposed. Moreover, the jet head 3 is sealingly connected to the inner wall of the first through hole and the inner wall of the second through hole so that the corrosion of the hull bottom plate 200 caused by seawater entering from between the jet head 3 and the hole walls of the first through hole and the second through hole and contacting the hull bottom plate 200 can be avoided when no air is ejected from the jet head 3. The shape and size of the jet head 3 may be customized according to actual use requirements. This is not limited here. In other embodiments, the material of the jet head 3 may select another material.

The backing plate 2 may be made of PE material or steel material. When the tonnage of the ship is less than 100,000 tons, the backing plate 2 is made of PE material. In this embodiment, when the ship is in navigation, and the deformation of the hull bottom plate 200 in the region covered by the pressure stabilizing cavum 11 along the length direction of the ship is less than a preset value, the backing plate 2 is also made of PE material. The determination of the preset value needs to be based on corresponding ship parameters. The thickness of the hull bottom plate 200 and the navigation speed of the ship are key ship parameters to determine the preset value. For example, the preset value may be 10 mm to 20 mm.

In this embodiment, when the backing plate 2 is made of PE material, the backing plate 2 and the hull bottom plate 200 are sealingly bonded through an epoxy adhesive, both end surfaces of the backing plate 2 along the length direction of the hull are sealingly connected to the hull bottom plate 200 through a first sealant 4, and the first sealant 4 is made of epoxy adhesive, anodic shield coating and sealant. The backing plate 2 made of PE material is used, and the opposite surfaces of the backing plate 2 and the hull bottom plate 200 are sealingly bonded through the epoxy adhesive so that the pressure stabilizing cavum structure can be prevented from being corroded. Moreover, the use of the epoxy adhesive can ensure the reliable connection between the backing plate 2 and the hull bottom plate 200 while the sealing performance can be ensured so that seawater can be prevented from entering between the backing plate 2 and the hull bottom plate 200 and contacting the hull bottom plate 200, thereby preventing the hull bottom plate 200 from being corroded by seawater. Two end surfaces of the backing plate 2 are sealingly connected to the hull bottom plate 200 through the first sealant 4 so that a better sealing effect between the backing plate 2 and the hull bottom plate 200 can be ensured, preventing seawater from entering and contacting the hull bottom plate 200. For example, each of the epoxy adhesive, anodic shield coating and sealant is coated with one layer at the joints between the hull bottom plate 200 and each of the two end surfaces of the backing plate 2 so that a triple sealing can be achieved, and the sealing effect can be ensured. In other embodiments, the type and number of the first sealant 4 may also be adaptively adjusted according to actual use conditions, and another type of adhesive may also be used for replacing the epoxy adhesive.

When the tonnage of the ship is greater than 100,000 tons, the backing plate 2 is made of steel material. In this embodiment, when the ship is in navigation, the deformation of the hull bottom plate 200 in the region covered by the pressure stabilizing cavum 11 along the length direction of the ship is greater than a preset value, the backing plate 2 is made of steel material. As for an ultra-large ship, due to the too large size of the ship, the length of the ship may exceed 200 m, during the navigation of this type of ship, the hull bottom plate 200 is deformed in the length direction of the ship, and the deformation scale gradually increases with the increase of the tonnage of the ship. Although the size of the pressure stabilizing cavum 11 in the length direction of the ship is at the level of several hundred millimeters, and the deformation of the hull bottom plate 200 has almost no impact on it, there is still a risk that the connection between the backing plate 2 made of PE material and the hull bottom plate 200 is partially torn, having a certain impact on the functions of the pressure stabilizing cavum 11 and the safety of the ship. The backing plate 2 made of steel material is used so that the sealing between the pressure stabilizing cavum 11 and the hull bottom plate 200 can be prevented from being affected by the deformation of the hull bottom. In addition, using steel backing plate 2 is equivalent to thickening the hull bottom plate 200 so that the anticorrosion of the pressure stabilizing cavum 11 can be facilitated.

In other embodiments, the backing plate 2 may adaptively select relatively mature corrosion-resistance materials in other industries based on different sizes, types and use environments of ships.

In this embodiment, when the backing plate 2 is made of steel material, both end surfaces of the backing plate 2 along the length direction of the hull are sealingly welded to the hull bottom plate 200, the each PE pipe 1 is sealingly connected to the backing plate 2 through an epoxy adhesive, both end surfaces of the each PE pipe 1 in the width direction of the first opening are sealingly connected to the backing plate 2 through a second sealant 7, and the second sealant 7 is made of epoxy adhesive, anodic shield coating and sealant. Both the two end surfaces of the backing plate 2 along the length direction of the hull are sealingly welded to the hull bottom plate 200 so that the sealing effect between the backing plate 2 and the hull bottom plate 200 can be ensured. The opposite surfaces between the each PE pipe 1 and the backing plate 2 are sealingly connected through an epoxy adhesive so that the sealing effect between the each PE pipe 1 and the backing plate 2 can be ensured. The second sealant 7 enables triple sealing between the two end surfaces of the each PE pipe 1 in the width direction of the first opening and the backing plate 2 so that the sealing effect can be ensured. In other embodiments, the number of layers and the types of materials of the second sealant 7 may be adaptively adjusted according to actual conditions. When the backing plate 2 selects another corrosion-resistant material, the types and disposed positions of the first sealant 4 and the second sealant 7 may be adaptively adjusted according to different materials of the backing plate 2.

Figure 3:
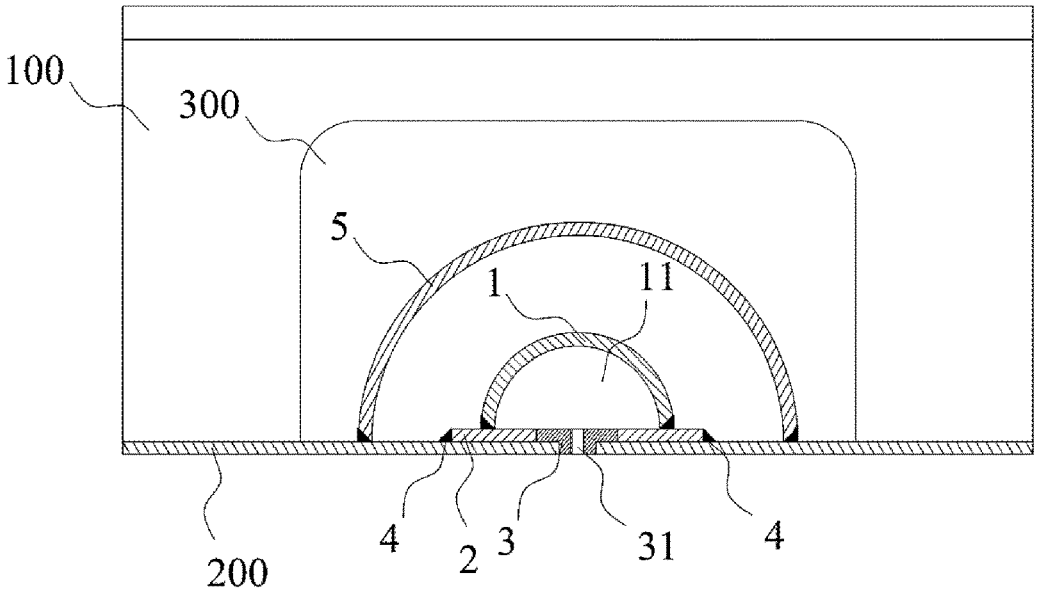
FIG. 3 is a diagram illustrating the structure of another pressure stabilizing cavum structure (with an outer sleeve and with a backing plate made of PE material) applicable to an air layer drag reduction ship according to another embodiment of the present application.

As shown in FIG. 3, the pressure stabilizing cavum structure applicable to an air layer drag reduction ship further includes an outer sleeve 5 extending along the width direction of the hull and provided with a second opening. The second opening extends along the width direction of the hull. Both sides of the outer sleeve 5 in the width direction of the second opening are connected to the hull bottom plate 200. The each PE pipe 1 and the backing plate 2 are spaced apart and inserted through the inside of the outer sleeve 5, and the outer wall of the outer sleeve 5 is welded to the longitudinal keel 100. The each PE pipe 1 in the preceding pressure stabilizing cavum structure is directly exposed in the ship cabin. Although the pressure resistance of PE material is very high, damage can still be caused by sharp objects, thereby disrupting the sealing of the pressure stabilizing cavum 11, causing air leakage, damaging the functionality of the pressure stabilizing cavum 11 and potentially allowing seawater from the pressure stabilizing cavum 11 to enter the inside of the hull through damage points and affecting the safety of the ship. The outer sleeve 5 can prevent the pressure stabilizing cavum 11 from being directly exposed to the outside. If there is a water leakage in the pressure stabilizing cavum 11, seawater enters the outer sleeve 5 so that seawater can be prevented from leaking into the inside of the hull.

The outer sleeve 5 is a steel pipe. Both sides of the steel pipe in the width direction of the second opening are welded to the hull bottom plate 200. In this embodiment, the cross section of the outer sleeve 5 is also semicircular, and the distance from the outer sleeve 5 to the each PE pipe 1 is greater than 10 cm so that the sealing process requirements can be ensured, while the impact of welding of the outer sleeve 5 on the each PE pipe 1 can be avoided. In other embodiments, the cross section of the outer sleeve 5 may also be in another shape such as a rectangular shape, and the material of the outer sleeve 5 may also select another material having a relatively good strength.

In other embodiments, the outer sleeve 5 may not be disposed. Whether to dispose the outer sleeve 5 is adaptively selected according to different ship types or different positions of the pressure stabilizing cavum structure on the ship and is not affected by the material of the backing plate 2.

Figure 4:
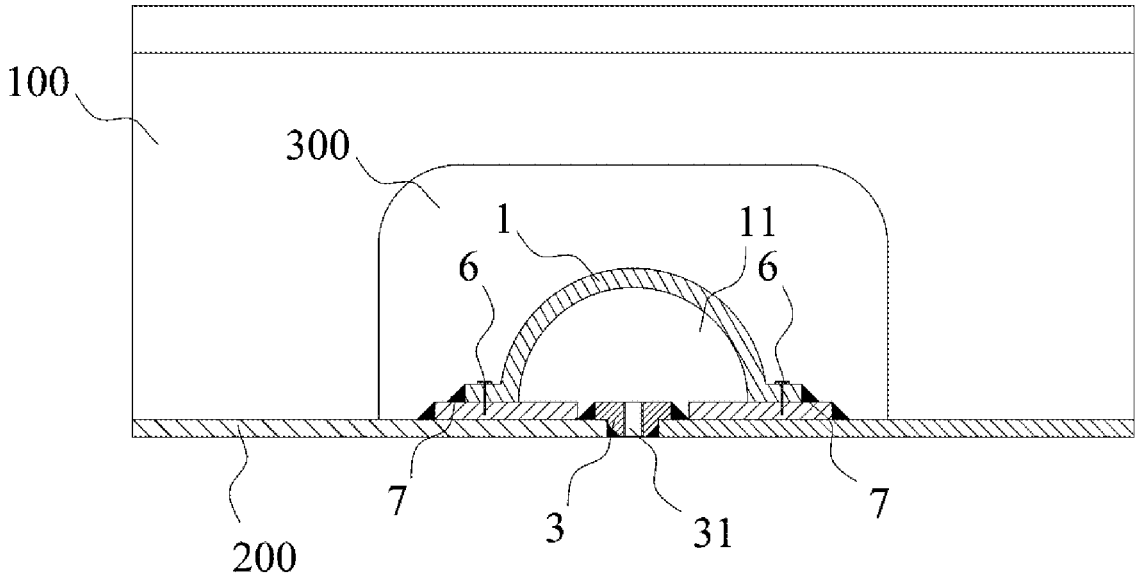
FIG. 4 is a diagram illustrating the structure of another pressure stabilizing cavum structure (without an outer sleeve and with a backing plate made of steel material) applicable to an air layer drag reduction ship according to yet another embodiment of the present application.

As shown in FIG. 4, the pressure stabilizing cavum structure applicable to an air layer drag reduction ship further includes fasteners 6. Both ends of the each PE pipe 1 at the first opening are connected to the backing plate 2 through fasteners 6. The two sides of the each PE pipe 1 in the width direction of the first opening extend outwards and are each provided with a connection portion. Two connection portions are connected to the backing plate 2 through two fasteners 6 respectively to cooperate the bonding between the two connection portions and the backing plate 2. This double connection mode can ensure a more reliable connection between the each PE pipe 1 and the backing plate 2. In this embodiment, the fastener 6 is a bolt, and in other embodiments, the fastener 6 may also be a pin or another structure.

Figure 2:
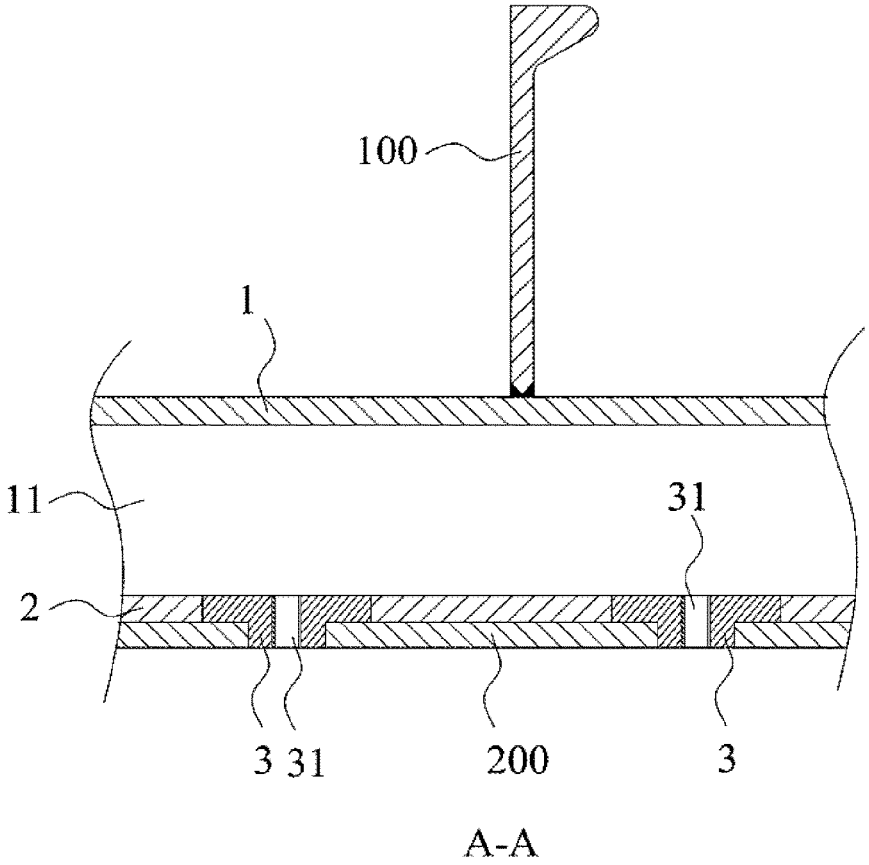
FIG. 2 is a sectional diagram taken along the A-A direction of FIG. 1.

In the pressure stabilizing cavum structure applicable to an air layer drag reduction ship as shown in FIGS. 1 and 2, the each PE pipe 1 may also be provided with a connection portion, and the connection portion is connected to the backing plate 2 through the fastener 6 to form a double connection mode to ensure the stability of the connection. In this embodiment, according to different requirements of different ship types on the stability of the pressure stabilizing cavum structure and on the reliability of the pressure stabilizing cavum structure in different positions on the ship, whether to use the fastener 6 may be adaptively selected; moreover, the setting of the fastener 6 is not affected by the material of the backing plate 2 and whether to dispose the outer sleeve 5.

In this embodiment, the pressure stabilizing cavum structure applicable to an air layer drag reduction ship further includes multiple zinc blocks, all of which are disposed inside the pressure stabilizing cavum 11 so that the anticorrosion of the pressure stabilizing cavum 11 can be facilitated. In other embodiments, no zinc block may be disposed, or a corrosion-resistant process may be performed on the basis of the pressure stabilizing cavum structure according to this embodiment to increase the corrosion resistance of the pressure stabilizing cavum structure.

In this embodiment, the each PE pipe 1 is also connected to an air inlet pipe. The air inlet pipe communicates with the pressure stabilizing cavum 11 and is also provided with structures such as a valve group. Air can be introduced into the pressure stabilizing cavum 11 through the air inlet pipe. Structures of the air inlet pipe and value group are related arts. Details are not repeated here.

In the pressure stabilizing cavum structure applicable to an air layer drag reduction ship according to this embodiment, the PE pipes 1 are used, the backing plate 2 uses the corrosion-resistant material, and the backing plate 2 is sealingly connected to the hull bottom plate 200 and each PE pipe 1 so that the anticorrosion problem of the pressure stabilizing cavum 11 can be solved, and the corrosion risk caused by seawater entering and contacting the hull bottom plate 200 can be eliminated. Moreover, according to different ship types and different positions of the pressure stabilizing cavum structure on the ship, the material of the backing plate 2 can be adaptively selected as the PE material or the steel material or another material, whether to dispose the outer sleeve 5 and the fastener 6 can be adaptively selected, and whether to use the jet head 3 and select the material of the jet head 3 can be adaptively selected. This forms a corrosion-resistant pressure stabilizing cavum structure with diverse structural forms, improving flexibility and diversity while ensuring the resolution of the anticorrosion problem of the pressure stabilizing cavum 11.

What is claimed is:

1. A pressure stabilizing cavum structure, applicable to an air layer drag reduction ship and disposed at a bottom of a hull of a ship, comprising:

a plurality of polyethylene (PE) pipes, wherein the plurality of PE pipes extend along a width direction of the hull, are arranged in parallel and spaced apart along a length direction of the hull, and are inserted through a longitudinal keel of the ship; and each PE pipe of the plurality of PE pipes is provided with a first opening extending along the width direction of the hull, and both sides of the each PE pipe in a width direction of the first opening are connected to a hull bottom plate of the ship to form a pressure stabilizing cavum; and a backing plate, extending along the width direction of the hull, wherein the backing plate is made of corrosion-resistant material, is located between the each PE pipe and the hull bottom plate and is sealingly connected to the each PE pipe and the hull bottom plate, the backing plate is provided with a first through hole, the hull bottom plate is provided with a second through hole communicating with the first through hole, and the pressure stabilizing cavum communicates with an outside of the ship through the first through hole and the second through hole;

wherein the backing plate is made of PE material or steel material;

wherein in a case where a tonnage of the ship is less than 100,000 tons, the backing plate is made of PE material; the backing plate and the hull bottom plate are sealingly bonded through an epoxy adhesive; and both end surfaces of the backing plate along the length direction of the hull are sealingly connected to the hull bottom plate through a first sealant, and the first sealant is made of epoxy adhesive, anodic shield coating and sealant.

2. The pressure stabilizing cavum structure according to claim 1, further comprising a jet head inserted through the first through hole and the second through hole and sealingly connected to an inner wall of the first through hole and an inner wall of the second through hole, wherein a jet hole is disposed inside the jet head, the pressure stabilizing cavum communicates with the outside of the ship through the jet hole, and the jet head is made of PE material or steel material.

3. The pressure stabilizing cavum structure according to claim 1, further comprising an outer sleeve extending along the width direction of the hull and provided with a second opening, wherein the second opening extends along the width direction of the hull, both sides of the outer sleeve in a width direction of the second opening are connected to the hull bottom plate, the each PE pipe and the backing plate are inserted through an inside of the outer sleeve, and an outer wall of the outer sleeve is welded to the longitudinal keel.

4. The pressure stabilizing cavum structure according to claim 3, wherein the outer sleeve is a steel pipe.

5. The pressure stabilizing cavum structure according to claim 1, wherein in a case where a tonnage of the ship is greater than 100,000 tons, the backing plate is made of steel material.

6. The pressure stabilizing cavum structure according to claim 5, wherein both end surfaces of the backing plate along the length direction of the hull are sealingly welded to the hull bottom plate; and the each PE pipe is sealingly connected to the backing plate through the epoxy adhesive, both end surfaces of the each PE pipe in the width direction of the first opening are sealingly connected to the backing plate through a second sealant, and the second sealant is made of epoxy adhesive, anodic shield coating and sealant.

7. The pressure stabilizing cavum structure according to claim 1, further comprising fasteners, wherein both ends of the each PE pipe in the width direction of the first opening are connected to the backing plate through fasteners.

8. The pressure stabilizing cavum structure according to claim 2, further comprising an outer sleeve extending along the width direction of the hull and provided with a second opening, wherein the second opening extends along the width direction of the hull, both sides of the outer sleeve in a width direction of the second opening are connected to the hull bottom plate, the each PE pipe and the backing plate are inserted through an inside of the outer sleeve, and an outer wall of the outer sleeve is welded to the longitudinal keel.

9. The pressure stabilizing cavum structure according to claim 2, further comprising fasteners, wherein both ends of the each PE pipe in the width direction of the first opening are connected to the backing plate through fasteners.

* * * * *